US005810671A

United States Patent [19]

Balwanz et al.

[11] Patent Number: 5,810,671

[45] Date of Patent: Sep. 22, 1998

[54] AMUSEMENT RIDE SYSTEM

[76] Inventors: C. Grant Balwanz, 229 Golden Rod Dr., Seymour, Tenn. 37865; Mark Kleimeyer, 120 Dragons Cir., Panama City Beach, Fla. 32411

[21] Appl. No.: 910,241

[22] Filed: Aug. 13, 1997

[51] Int. Cl.[6] ..... A63G 9/12

[52] U.S. Cl. ..... 472/118; 472/125

[58] Field of Search ..... 472/118, 119, 472/133, 49, 50, 136, 137, 125, 131

[56] References Cited

U.S. PATENT DOCUMENTS

| | | | |
|---|---|---|---|
| 2,221,215 | 11/1940 | Eyerly | 472/131 |
| 2,779,596 | 1/1957 | Ridgway | 472/118 |
| 3,140,870 | 7/1964 | Walker | 472/118 |
| 5,421,783 | 6/1995 | Kockelman et al. | 472/135 |
| 5,527,223 | 6/1996 | Kitchen et al. | 472/118 |

*Primary Examiner*—Kien T. Nguyen
*Attorney, Agent, or Firm*—Michael E. McKee

[57] ABSTRACT

An amusement ride system includes a chair assembly within which an occupant is seated during the course of a ride and a pair of upstanding towers fixedly secured to the ground in a spaced relationship. Bungee cords are joined to each side of the chair assembly and have ends which extend toward the upper portions of the tower. By securing the chair assembly to the ground at a ready position and tensioning the bungee cords to a stretched condition, the chair assembly is biased upwardly by the stretched condition of the bungee cords. The system also includes guide rails which cooperate with the chair assembly so that upon release of the chair assembly from its release position, the chair assembly is guided along a preselected path for at least a short period of time following release of the chair assembly to prevent the chair assembly from being thrown through the air by the bungee cords until the chair assembly has been guided along the preselected path.

20 Claims, 4 Drawing Sheets

AMUSEMENT RIDE SYSTEM

BACKGROUND OF THE INVENTION

This invention relates generally to amusement ride systems and relates, more specifically, to such systems which throw individuals through the air.

Amusement rides are known which employ bungee cords for throwing individuals through the air and for supporting the individual during a following period during which the individual oscillates in a bouncing motion until he stops. One such apparatus is shown and described in pending U.S. patent application Ser. No. 08/610,161, filed Feb. 29, 1996 and utilizes two spaced-apart towers, a chair assembly positioned generally between the towers, and bungee cords which extend between the upper end of the towers and the chair assembly. To use the ride, the chair assembly is initially secured to the ground and then the bungee cords are pulled to a stretched condition. The chair assembly is subsequently released from its secured condition at the ground so that the chair assembly (and any individual seated therein) is thrown by the bungee cords generally upwardly through the air and subsequently bounces up and down as the bungee cords seek to return to a relaxed condition.

It is an object of the present invention to provide a new and improved amusement ride system which employs bungee cords for throwing an individual through the air.

Another object of the present invention is to provide such an amusement ride system which, during use, moves an individual along a path which enhances the thrill imparted to the individual as he is moved through the air.

Still another object of the present invention is to provide such an amusement ride system which, during use, moves an individual along somewhat of an elliptical path.

Yet another object of the present invention is to provide such an amusement ride system which is uncomplicated in construction yet effective in operation.

SUMMARY OF THE INVENTION

This invention resides in an amusement ride system including a chair assembly for supporting an individual during the course of a ride and means providing first and second elevated supports arranged in a spaced relationship. The chair assembly is arranged generally between the first and second elevated supports, and the system further includes first bungee cord means having two opposite ends wherein one end of the first bungee cord means is joined to the chair assembly and second bungee cord means having two opposite ends wherein one end of the second bungee cord means is joined to the chair assembly. Means are associated with the first and second elevated supports for pulling upon the ends of the first and second bungee cord means opposite the one ends thereof to which the first and second bungee cord means are joined for tensioning the first and second bungee cord means from a relaxed condition to a stretched condition. The system also includes means for holding the chair assembly in a ready position between the first and second elevated supports as the bungee cord means are pulled to a stretched condition and means for releasing the chair assembly from its ready position so that the stretched bungee cord means are permitted to move the chair assembly from the ready position.

In addition, means are associated with the chair assembly for confining the movement of the chair assembly along a predetermined path for a period of time following the release of the chair assembly from the ready position so that until the end of said period of time, the bungee cord means are prevented from throwing the chair assembly through the air.

DETAILED DESCRIPTION OF THE ILLUSTRATED EMBODIMENT

Figure 1:
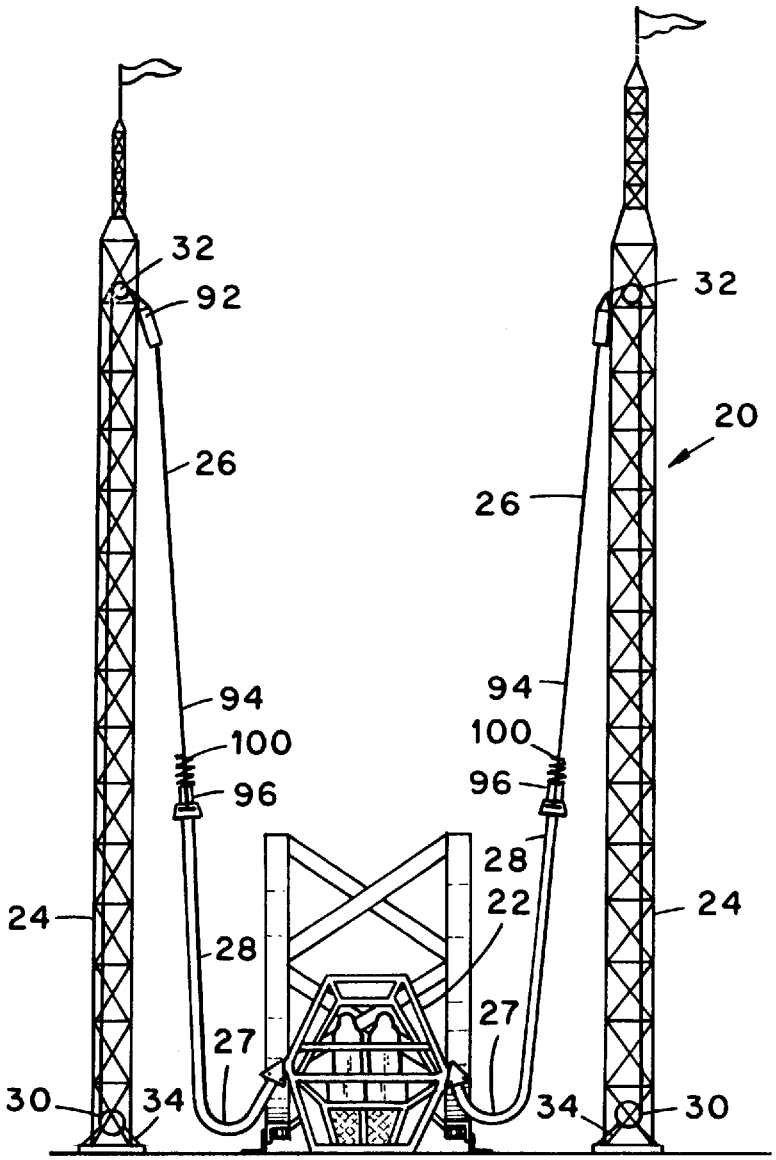
FIG. 1 is a front elevational view of an amusement ride system within which features of the present invention are embodied.
Figure 2:
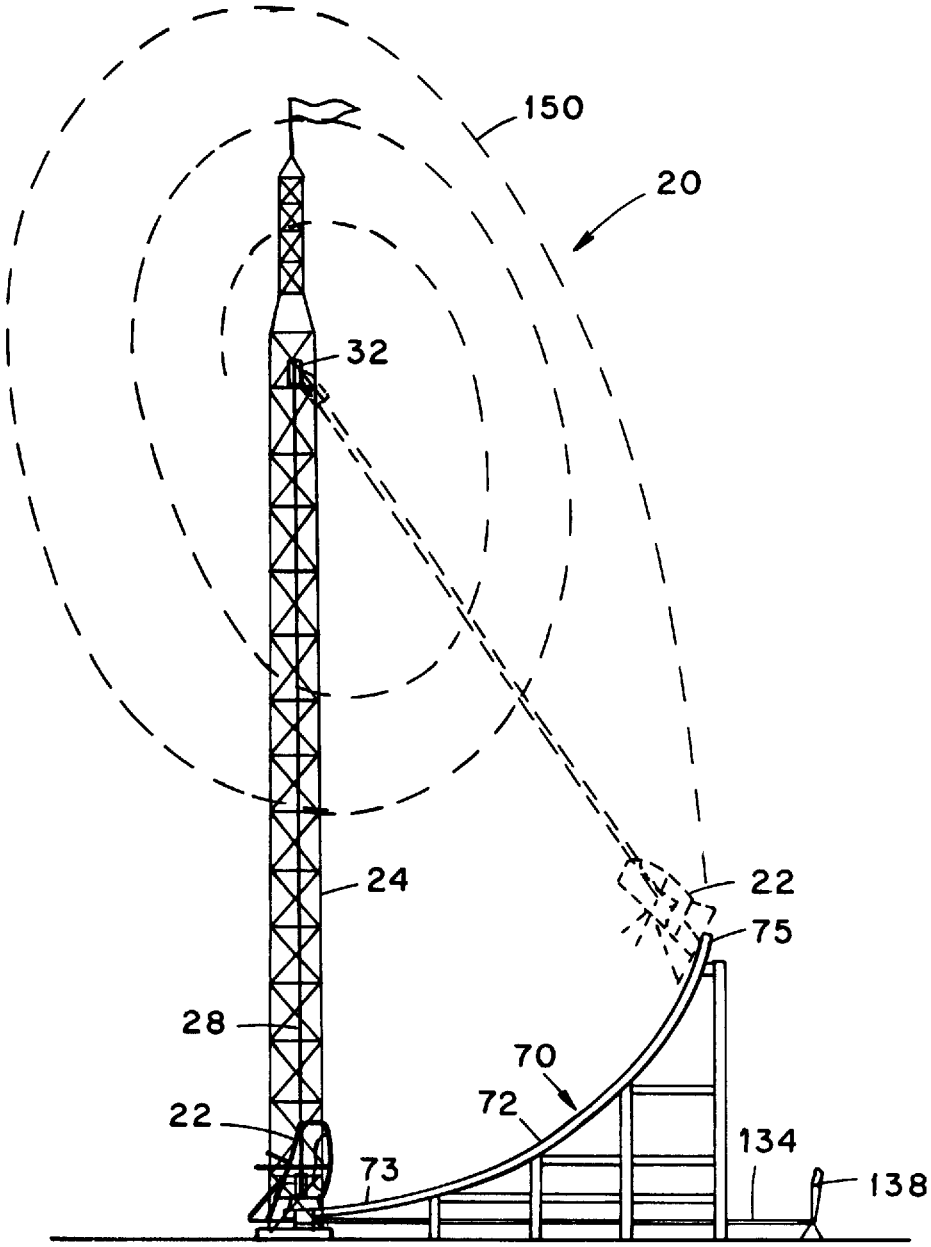
FIG. 2 is a side elevational view of the FIG. 1 system, as viewed generally from the right in FIG. 1.

Turning now to the drawings in greater detail, there is illustrated in FIGS. 1 and 2 an amusement ride system 20 within features of the present invention are embodied. The depicted ride 20 includes a chair assembly 22 and pair of spaced, stationary towers 24 between which the chair assembly 22 is positioned. Joined to each side of the chair assembly 22 is one end, indicated 27, of a bungee cord means 28, and the other, opposite end of the bungee cord means 28 is joined to a tensioning cable 26. The tensioning cable 26 is, in turn, connected to a rotatable spool 30 by way of a pulley 32 secured adjacent the upper end of a corresponding tower 24. A electric motor 34 is drivingly connected to the spool 30 so that upon actuation of the motor 34, the cable 26 is wound about the spool 30 to tension the bungee cord means 28 disposed on each side of the chair assembly 22 to a stretched condition.

By securing the chair assembly 22 to the ground in a stationary, or ready, position as illustrated in FIG. 1 and then winding the cables 26 for a predetermined distance about the spools 30, the bungee cord means 28 are stretched from a relaxed, undeformed condition to a stretched (i.e. lengthened) condition. By subsequently releasing the chair assembly 22 from the ground while the bungee cord means 28 are in the stretched condition, the assembly 22 is urged from the ground by the bungee cord means 28 as the bungee cord means 28 attempt to return to the relaxed condition.

It is a feature of the ride system 20 that it includes means, generally indicated 21, for confining the movement of the chair assembly 22 along a predetermined path for at least a short period of time following release of the chair assembly 22 from its FIG. 1 ready position so that the chair assembly 22 is prevented from being thrown through the air by the bungee cord means 28 until the chair assembly 22 has been moved along the predetermined path. The stretched condition of the bungee cord means 28 provide the force for moving the chair assembly 22 along the predetermined path as well as the power for throwing the chair assembly 22 through the air when the chair assembly 22 reaches the end of the predetermined path. As will be apparent herein, by moving the chair assembly 22 along the predetermined path before it is thrown through the air, movements are imparted to the chair assembly 22, and hence to an individual seated within the chair assembly 22, which would not otherwise be imparted to the chair assembly 22 if the chair assembly 22 were simply released from the ground to follow, and ultimately oscillate along, a substantially vertical path between the towers 24.

With reference still to FIGS. 1 and 2, each upstanding tower 24 includes a steel framework having a lower end 50 which is anchored within the ground and an upper end 52 which extends an appreciable distance above the ground. As will be apparent herein, the upper end 52 of the framework provides an elevated support for the cable pulley 32, introduced above.

Figure 3:
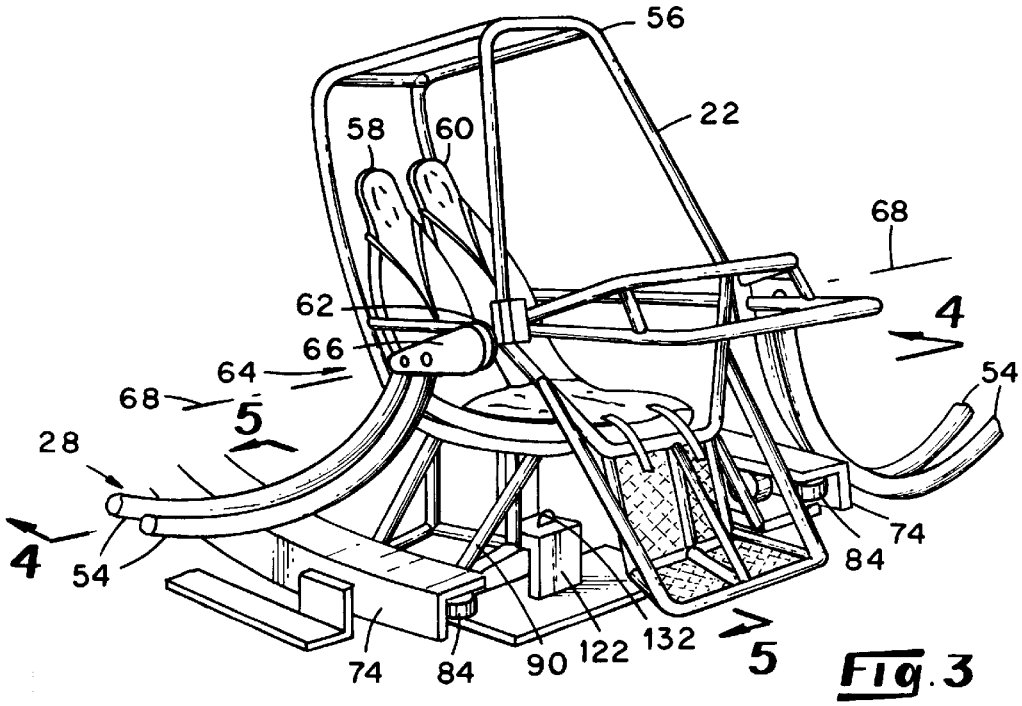
FIG. 3 is a fragmentary perspective view of the FIG. 1 system illustrating the chair assembly thereof.

With reference to FIGS. 1–3, the chair assembly 22 includes a cage 56 comprised of a plurality of steel tubes which are welded together to form a cage-like protective frame within which a pair of seats 58 are secured. For use of the ride 20, the chair assembly 22 is arranged between the towers 24 so that each tower 24 is disposed to a corresponding side of the chair assembly 22 and so that the front of the chair assembly 22 faces to the left as viewed in FIG. 2. Associated with each seat 58 is a five-point harness assembly 60 for securing an individual within the seat 58 when an individual is seated therein. For a more detailed description of the structure of the cage 56, seats 58 and harness assemblies 60, reference can be had to co-pending application Ser. No. 08/610,161 entitled CHAIR ASSEMBLY FOR AN AMUSEMENT RIDE, filed Feb. 29, 1996, the disclosure of which is incorporated herein by reference.

Each bungee cord means 28 of the system 28 includes two bungee cords 54 which extend between a corresponding side of the cage 56 and a corresponding tensioning cable 26. To accommodate the securement of each bungee cord 54 to the chair assembly 22 and as best shown in FIG. 3, there is provided on each side of the chair assembly 22 a bearing assembly 62 having a spindle-carrying inner portion secured in a stationary condition with respect to the cage 56 and a hub-including outer portion 66 to which each bungee cord 54 is secured. Each outer portion 66 is rotatably fixed to the spindle-carrying inner portion to accommodate rotation of the outer portion 66 relative thereto about a pivot axis 68. During the operation of the ride system 20 during which the cage 56 may be expected to roll or be turned upside down as the cage 56 is thrown through the air by the bungee cord means 28, the bearing assemblies 62 prevent the bungee cords 54 from exposure to undue strain which could otherwise result from the development of kinks along the length of the cords 54. For a more detailed description of the bearing assemblies 62 of the chair assembly 22, reference can be had to the aforementioned patent application Ser. No. 08/610,161.

With reference again to FIG. 1, the end of each bungee cord 54 opposite the bearing assembly 22 is securely joined to the end of a corresponding tensioning cable 26. Furthermore, there is pivotally mounted on each tower 24 a rooster-head assembly 92 through which the cable 26 is routed as it extends from the pulley 32 toward the chair assembly 22, and there is mounted upon the end, indicated 94, of the tensioning cable 34 a compression spring assembly 96 having a compression spring 100. During the tensioning of the bungee cord means 28 and after winding the cable 26 about the spool 30 by a sufficient amount (during which the chair assembly 22 is secured to the ground at its FIG. 1 ready position), the compression spring assembly 96 abuts the rooster-head assembly 92 so that continued winding of the cable 26 about the spool 30 effects a compression of the spring 100 to a compressed condition. As the bungee cords 54 are being tensioned to a stretched condition, an operator of the system 20 watches the ends 94 of the tension cables 26, and the motors 34 are automatically de-actuated when the assembly 96 engages the rooster-head assembly 92. The cooperation between the rooster-head assembly 92 and the spring assembly 96 cushions what could otherwise be a relatively hard impact between the rooster-head assembly 92 and the cable end 94. Moreover, the engagement between the rooster-head assembly 92 and the spring assembly 96 maintain the cable 26 in a taut condition as the chair assembly 22 is being thrown through the air and dampens any lengthwise oscillations of the cable 26 which may otherwise result as the pull exerted upon the cable 26 by way of the stretched bungee cord means 28 is suddenly released.

Figure 4:
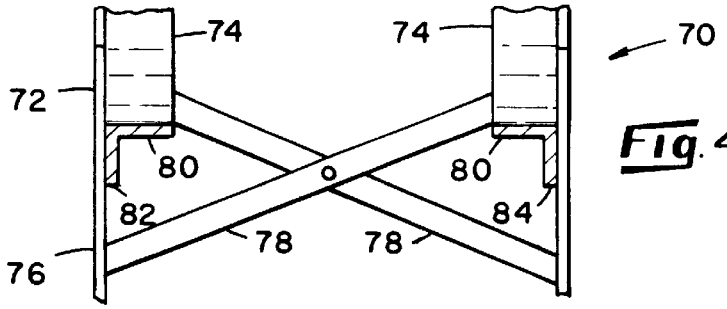
FIG. 4 is a fragmentary cross-sectional view of the guide track of the FIG. 1 system taken about along line 4—4 of FIG. 3.

With reference to FIGS. 2 and 4, the movement-confining means 21 of the system 20 includes a cooperating guide track and guide track providing means 70 including a guide track 72 which extends from a location situated adjacent the FIG. 1 ready position of the chair assembly 22 to an elevated location disposed behind the chair assembly 22. In particular, the guide track 72 has a proximal end 73 which is disposed adjacent the chair assembly 22 when the chair assembly 72 is positioned in its FIG. 1 ready position and has a distal end 75 which is located behind the chair assembly 22 and at an appreciable elevation above the ground. In the depicted system 20, the guide track 72 is provided by a pair of guide rails 74 supported in a spaced and parallel relationship along the length of the guide track 72. The guide rails 74 are, in turn, supported by rigid steel framework 76 including braces 78 which are anchored to one another and to the ground so that the guide rails 74 are rigidly secured in a stationary condition with respect to the ground. As best shown in FIG. 4, each guide rail 74 defines a downwardly-facing surface 80 and an inwardly-facing surface 82 which each extend along the length of the guide track 72.

In order that the chair assembly 22 must move along the length of the guide track 72 from the proximal end 73 to the distal end 75 thereof after its release from the ready position, the chair assembly 22 includes a plurality of guide rollers 84, 86 which are rotatably mounted generally beneath the cage 56 of the chair assembly 22 for rollably moving along the length of the rails 74. In the depicted system 20, two rollers 86 are rotatably supported below and along each side of the cage 56 for rollably engaging the downwardly-facing surface 80 of a corresponding guide rail 74, and two rollers 84 are rotatably supported below and along each side of the cage 56 for rollably engaging the inwardly-facing surface 82 of a corresponding guide rail 74. Since the stretched condition of the bungee cord means 28 urges the chair assembly 22 generally upwardly from its release position as the chair assembly 22 is moved along the guide track 72, the rollers 86 are maintained in rolling engagement with the downwardly-facing surfaces 80 of the guide rails 104 in opposition to the forces of gravity as long as the chair assembly 22 is moved along the guide track 72.

Figure 5:
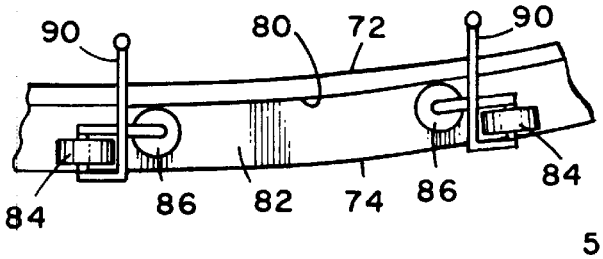
FIG. 5 is a fragmentary cross-sectional view taken about along line 5—5 of FIG. 3 and which schematically illustrates the cooperation between the chair assembly and the guide track of the FIG. 1 system.

As best shown in FIGS. 3 and 5, both sets of rollers 84 and 86 are rotatably attached to the underside of the cage 56 by means of a steel support frame 90 joined between the cage 56 and the rollers 84 and 86. It follows that the frame 90 supports each roller 84 and 86 for rotation about a corresponding axis which is substantially parallel to the location (or more specifically, a tangent plane drawn through the location) along the surface 80 or 82 being rollably engaged by the roller 84 or 86.

Figure 6:
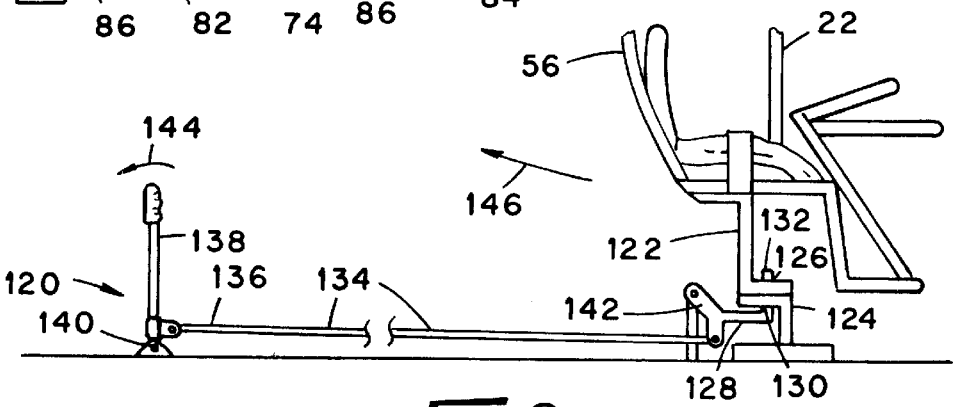
FIG. 6 is a fragmentary elevational view of the FIG. 1 system as seen from the left in FIG. 1.

With reference to FIG. 6, the system 20 also includes means, generally indicated 120, for releasably holding the chair assembly 22 in a secured, stationary condition at the FIG. 1 ready position while the bungee cord means 28 are extended to the stretched condition in preparation for use of the ride system 20. To this end, there is attached to the cage 56 a downwardly-depending flange section 122 adapted to be cooperatively attached to a post 124. The flange 122 is fixedly secured, as with welds, to the underside of the cage 56 and defines a generally upwardly-opening through-opening 126. The post 124 is, in turn, fixedly secured to the ground in a substantially vertical orientation and includes a horizontally-oriented boss 128 having an opening 130. The chair assembly 22 is positionable between the guide rails 74 so that the flange opening 126 is aligned with the post opening 130, and the aligned openings 126, 130 are adapted to accept one end 132 of a rod assembly 134. With the rod assembly end 132 inserted through the aligned openings 126, 130, the chair assembly 22 is pinned to the ground.

The opposite rod assembly end, indicated 136 in FIG. 6, is pivotally connected to a lever 138 which, in turn, is pivotally connected to the ground by way of a pivot pin 140. A linkage assembly 142 is joined intermediate of the rod assembly ends 132 and 136 so that by manually moving the lever 138 in the direction of the FIG. 6 arrow 144, the rod assembly end 132 is moved downwardly to withdraw the rod assembly end 132 from the flange opening 126 and thereby release the chair assembly 22 from its FIG. 1 release position. Upon release of the chair assembly 22 from its FIG. 1 release position, the chair assembly 22 is moved, under the influence of the stretched bungee cord means 28, in the direction of the FIG. 6 arrow 146 and along the length and off of the distal end 75 of the guide track 72.

To prepare the ride system 20 for use following the termination of a previous ride (at which the chair assembly 22 is normally suspended in the air between the two towers 24), the motors 34 are energized to lower the chair assembly 22 to a position close to the ground at which the weight of the chair assembly 22 is still supported by the cables 26. At that point, the chair assembly 22 is manually manipulated (i.e. guided) between the guide rails 74 so that the rollers 84, 86 are positioned in rolling engagement with the corresponding surfaces 80, 82 of the guide rails 74 at the proximal end of the guide track 72 and so that the flange through-opening 126 is positioned in alignment with the post opening 130. To facilitate the guiding of the rollers 84, 86 against the guide rails 74 as aforedescribed, the proximal ends of the guide rails 74 can be appropriately shaped, or flared, to help funnel the rollers 84, 86 into place as the chair assembly 22 is guided between the rails 74. With the openings 126 and 130 in aligned relationship, the lever 138 is appropriately moved to insert the rod assembly end 132 through the aligned openings 126 and 130 and thereby pin the chair assembly 22 to the ground. With the chair assembly 22 pinned to the ground at the FIG. 1 ready position, any passengers who may remain in the chair assembly 22 can depart therefrom, and other individuals who wish to ride the ride 20 can be seated and fastened within the chair assembly 22.

After loading and securing the passengers within the chair assembly 22, the motors 34 are simultaneously actuated so that the tensioning cables 26 begin to be wound about the spools 30 to raise the upper ends of the bungee cords 54 toward the rooster-head assemblies 92 and thereby stretch the bungee cord means 28. When each spring assembly 96 engages it corresponding rooster-head assembly 92, the motors 34 are de-actuated thereby rendering the bungee cords 54 in a fully stretched condition and readying the chair assembly 22 for release from its release position. To release the chair assembly 22, the operator moves the lever 138 to withdraw the rod assembly end 132 from the flange opening 126 and thereby unpin the chair assembly 22 from the ground.

Upon release of the chair assembly 22 from the ground, the stretched bungee cords 54 strongly urge the chair assembly 22 upwardly. Of course, since the rollers 84, 86 are confined between the corresponding surfaces of the guide rails 74, the chair assembly 22 is prevented from moving directly upwardly by the stretched bungee cords 54. Instead, and due to the generally upwardly-arched shape of the guide track 72 (best shown in FIG. 2), the chair assembly 22 is moved rearwardly (to the elevated position illustrated in phantom in FIG. 2) and off of the distal end 75 of the guide track 72 under the influence of the stretched bungee cords 54. Upon leaving the distal end 75 of the guide track 72, the chair assembly 22 is thrown generally upwardly and forwardly through the air by the bungee cords 54.

In order for the chair assembly 22 to be pulled along the guide track 72 from the proximal end 73 to the distal end 75 thereof, the guide track 72 must be shaped so that the chair assembly 22 physically moves toward the rooster-head assemblies 92 mounted at the upper ends of the towers 24 as the chair assembly 22 is progressively moved along the length of the guide track 72. Consequently, the distances measured between locations along the guide track 72 and either of the rooster-head assemblies 92 are progressively smaller as a path is traced along the guide track 72 from the proximal end 73 to the distal end 75 thereof. In the depicted embodiment 20, the guide track 72 is arcuately shaped to impart a relatively smooth, bounce-free motion to the chair assembly 22, and hence to the passengers seated therein, as the chair assembly 22 is guided along the guide track 72 from the proximal end 73 to the distal end 75 thereof.

Upon reaching the distal end 75 of the guide track 72, the rollers 84, 86 roll off the corresponding surfaces 80, 82 of the guide rails 74 and permit the bungee cords 54 (which have not yet reached a relaxed condition when the chair assembly 22 reaches the distal end 75) to throw the chair assembly 22 through the air. By appropriately positioning the distal end 75 of the guide track 72 at an appropriate location (such as is shown in FIG. 2 disposed to one side of a vertical plane containing the towers 24 and rearwardly of the chair assembly 22) so that a considerable amount of potential energy remains in the stretched bungee cords 54 when the chair assembly 22 reaches the distal end 75 of the guide track 72, the chair assembly 22 is thrown forwardly and upwardly by the bungee cords 54 to an elevation which is slightly higher than that of the towers 24 before the chair assembly 22 begins to fall. The chair assembly 22 thereafter repeatedly moves rearwardly and forwardly relative to the towers 24 in a combined bouncing and swinging motion before the bungee cords 54 attain a fully relaxed condition. The path, as viewed from one side, traveled by the chair assembly 22 following its release from the distal end 75 of the guide track 72 is indicated 150 in FIG. 2 and resembles somewhat of an elliptical path. When the rearward and forward movement, as well as the upward and downward movement, of the chair assembly 22 finally comes to a halt with the chair assembly 22 being suspended in the air by the cords 54, the chair assembly 22 may be lowered to the ground by unwinding the tensioning cables 26. The chair assembly 22 can then be re-connected to the post 122 by means of the rod assembly end 132 in preparation for a subsequent ride.

To enhance the thrill of the ride 20 as the chair assembly 22 is moved through the air, the passengers of the chair assembly 22 may, by appropriately shifting their weight within the cage 56, choose to impart a roll to the chair assembly 22 when it moves off of the distal end 75 of the guide track 72.

It follows from the foregoing that an amusement ride system 20 has been described which, by way of its two towers 24, bungee cords 54 and guide track 72, is capable of moving an individual (i.e. a passenger seated within the chair assembly 22) along a predetermined path before the bungee cord means 28 are permitted to throw the individual through the air along a non-vertical and non-horizontal path. The tensioning of the bungee cords 54 to a fully-stretched condition is effected by the winding of the tensioning cables 26 as the chair assembly 22 remains pinned to the ground, and the cooperation between the chair assembly 22 and the guide track 72 forces the chair assembly 22 to move along the full length of the guide track 72 before the stretched bungee cords 54 are permitted to throw the chair assembly 22 through the air. By confining the movement of the chair assembly 22 along the guide tracks 72 as aforedescribed, a thrill is imparted to the individual which he would not otherwise experience if the bungee cords 54 were permitted to simply throw the chair assembly 22 vertically from the ready position.

Exemplary dimensions of the amusement ride system 20 are as follows: The height of each pulley 32 (as measured from the ground) is about 70 feet and the distance between the two towers 24 is about fifty feet.

Figure 7:
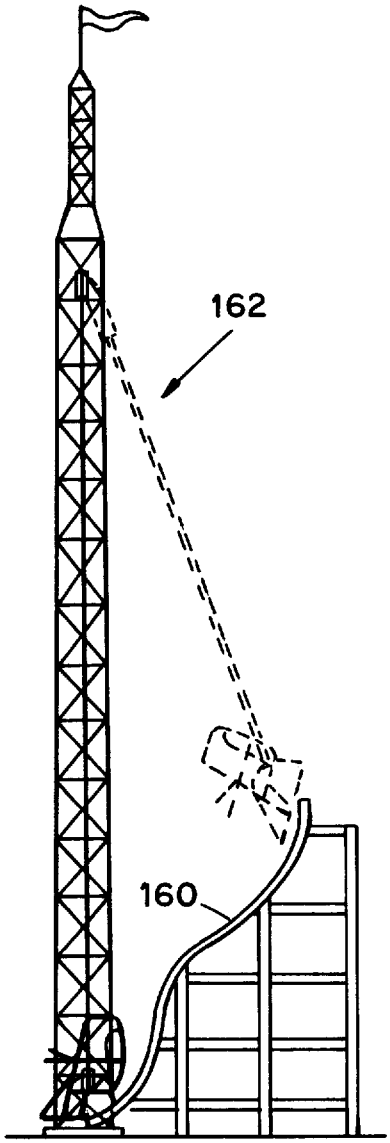
FIGS. 7 and 8 are views similar to that of FIG. 2 in which alternative embodiments of the system of the invention are depicted.
Figure 8:
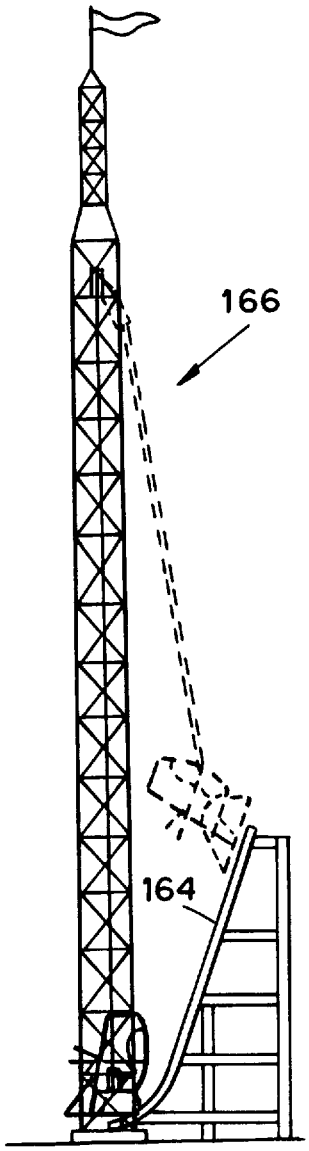

It will be understood that numerous modifications and substitutions can be had to the aforedescribed embodiment without departing from the spirit of the invention. For example, although the aforedescribed embodiment 20 has been shown and described as including a guide track 72 having a curvature whose arcuate portion opens generally upwardly, an alternative embodiment of a system can include a guide track having a curvature including an arcuate portion which opens somewhat downwardly, as does the guide track 160 of the system embodiment 162 depicted in FIG. 7. Furthermore, an alternative embodiment of a system can include a guide track including a linear section, as does the guide track 164 of the system embodiment 166 depicted in FIG. 8. Accordingly, the aforedescribed embodiment 20 is intended for the purpose of illustration and not as limitation.

We claim:

1. An amusement ride system comprising:

a chair assembly for supporting an individual during the course of a ride;

means providing first and second elevated supports arranged in a spaced relationship;

the chair assembly being arranged generally between the first and second elevated supports;

first bungee cord means having two opposite ends wherein one end of the first bungee cord means is joined to the chair assembly;

second bungee cord means having two opposite ends wherein one end of the second bungee cord means is joined to the chair assembly;

means associated with the first and second elevated supports for pulling upon the ends of the first and second bungee cord means opposite the one ends thereof to which the first and second bungee cord means are joined to the chair assembly for tensioning the first and second bungee cord means from a relaxed condition to a stretched condition while the chair assembly is releasably held in a ready position between the first and second supports;

means associated with the chair assembly for confining the movement of the chair assembly along a predetermined path for a period of time following the release of the chair assembly from the ready position so that until the end of said period of time, the bungee cord means are prevented from throwing the chair assembly through the air.

2. The system as defined in claim 1 wherein the associated means includes means for maintaining the chair assembly in a confined condition for the duration of said period of time so that for the duration of said period, the chair assembly is guided along said predetermined path and so that upon termination of said period, the chair assembly is released from said confined condition and the bungee cord means are permitted to throw the chair assembly through the air.

3. The system as defined in claim 1 wherein one of the associated means and the chair assembly includes means providing a guide track and the other of the associated means includes means providing a guide track follower which cooperates with the guide track so that as the chair assembly is guided along the predetermined path, the guide track follower is guided along the guide track.

4. The system as defined in claim 3 wherein the guide track and guide track follower cooperatively maintain the chair assembly in a confined condition for the duration of said period of time so that for the duration of said period, the chair assembly is guided along said predetermined path and so that upon termination of said period, the chair assembly is released from said confined condition so that the bungee cord means are permitted to throw the chair assembly through the air.

5. The system as defined in claim 1 wherein the chair assembly has a front and the associated means is adapted to confine the movement of the chair assembly along a predetermined path which extends generally rearwardly of the chair assembly when the chair assembly is positioned in the ready position.

6. The system as defined in claim 5 wherein the predetermined path includes a non-linear section.

7. The system as defined in claim 5 wherein the predetermined path includes a linear section.

8. The system as defined in claim 1 wherein the chair assembly has a front and the predetermined path terminates at a location disposed rearwardly of the chair assembly so that upon movement of the chair assembly through the predetermined path, the chair assembly is thrown in a forwardly direction through the air by the bungee cord means.

9. The system as defined in claim 1 further comprising:

means for releasably securing the chair assembly at the ready position while the first and second bungee cord means are tensioned from the relaxed condition to the stretched condition; and means for releasing the chair assembly from its ready position so that the chair assembly is moved by the bungee cord means along the predetermined path and then through the air.

10. An amusement ride system comprising:

a chair assembly for supporting an individual during the course of a ride;

means providing first and second elevated supports arranged in a spaced relationship;

the chair assembly being arranged between the first and second elevated supports;

first bungee cord means having two opposite ends wherein one end of the first bungee cord means is joined to the chair assembly;

second bungee cord means having two opposite ends wherein one end of the second bungee cord means is joined to the chair assembly;

means associated with the first and second elevated supports for pulling upon the ends of the first and second bungee cord means opposite the one ends thereof to which the first and second bungee cord means are joined for tensioning the first and second bungee cord means from a relaxed condition to a stretched condition;

means for releasably securing the chair assembly in a ready position between the first and second elevated supports as the bungee cord means are pulled to a stretched condition;

means for releasing the chair assembly from its ready position so that the first and second bungee cord means are permitted to move the chair assembly as the first and second bungee cord means moves from the stretched condition toward the relaxed condition; and means for cooperating with the chair assembly so that the chair assembly is guided along a predetermined path for at least a short period of time following release of the chair assembly from the ready position to prevent the chair assembly from being thrown through the air by the stretched bungee cord means until the chair assembly has been guided along the predetermined path.

11. The system as defined in claim 10 wherein the cooperating means includes means for maintaining the chair assembly in a confined condition for the duration of said period of time so that for the duration of said at least short period of time, the chair assembly is guided along said predetermined path and thereby prevented from being thrown through the air by the stretched bungee cords and so that upon termination of said at least short period of time, the chair assembly is released from said confined condition and the bungee cord means are permitted to throw the chair assembly through the air.

12. The system as defined in claim 10 wherein one of the cooperating means and the chair assembly includes means providing a guide track and the other of the cooperating means includes means providing a guide track follower which cooperates with the guide track so that as the chair assembly is guided along the predetermined path, the guide track follower is guided along the guide track.

13. The system as defined in claim 12 wherein the guide track and guide track follower are adapted to cooperatively maintain the chair assembly in a confined condition for the duration of at least said period of time so that for the duration of said at least short period of time, the chair assembly is guided along said predetermined path and so that upon termination of said at least short period of time, the chair assembly is released from said confined condition and the bungee cord means are permitted to throw the chair assembly through the air.

14. The system as defined in claim 10 wherein the chair assembly has a front and the cooperating means is adapted to confine the movement of the chair assembly along a predetermined path which extends generally rearwardly of the chair assembly when the chair assembly is positioned in the ready position.

15. The system as defined in claim 14 wherein the predetermined path includes a non-linear section.

16. The system as defined in claim 14 wherein the predetermined path includes a linear section.

17. The system as defined in claim 10 wherein the chair assembly has a front and the predetermined path terminates at a location disposed rearwardly of the chair assembly so that following movement of the chair assembly through the predetermined path, the chair assembly is thrown in a forwardly direction through the air by the bungee cord means.

18. The system as defined in claim 10 wherein the predetermined path includes a section which is offset to one side of a vertical plane containing the first and second elevated supports.

19. The system as defined in claim 10 wherein the chair assembly is biased by the stretched bungee cords from the ready position toward an imaginary line extending between the ends of the first and second bungee cord means opposite the one ends thereof to which the first and second bungee cord means are joined, and the preselected path along which the chair assembly is guided by the cooperating means includes a section which is not directed toward said imaginary line.

20. In an amusement ride system including a chair assembly within which an occupant is seated during the course of a ride performed with the system, a pair of upstanding first and second towers disposed on opposite sides of the chair assembly and fixedly secured to the ground in a spaced relationship, a first bungee cord means having two opposite ends wherein one end of the first bungee cord means is joined to one side of the chair assembly and the other end of the first bungee cord means extends toward the upper portion of the first tower, a second bungee cord means having two opposite ends wherein one end of the second bungee cord means is joined to the side of the chair assembly opposite said one side and the other end of the first bungee cord means extends toward the upper portion of the second tower, and means associated with the upper portion of the towers and joined to the extending ends of the first and second bungee cord means for tensioning the first and second bungee cord means between the chair assembly and the upper portion of the first and second towers to a stretched condition while the chair assembly is releasably secured in a ready position, and means for releasing the chair assembly from the ready position when the bungee cord means are in the stretched condition so that the chair assembly is forcibly moved from the ready position by the stretched bungee cord means, the improvement comprising:

means associated with the chair assembly for confining the movement of the chair assembly along a predetermined path for a period of time following the release of the chair assembly from the ready position so that until the end of said period of time, the bungee cord means are prevented from throwing the chair assembly through the air.

* * * * *